United States Patent [19]

Clifford

[11] 4,216,561

[45] Aug. 12, 1980

[54] IMPLEMENT FOR CLEANING BOX CULVERTS

[76] Inventor: Jack R. Clifford, 1817 State St., Alton, Ill. 62002

[21] Appl. No.: 26,806

[22] Filed: Apr. 3, 1979

[51] Int. Cl.[2] ..... B08B 9/02

[52] U.S. Cl. ..... 15/104.3 R

[58] Field of Search ..... 15/104.3 R

[56] References Cited

U.S. PATENT DOCUMENTS 1,344,249 6/1920 Stewart ..... 15/104.3 R

*Primary Examiner*—Edward L. Roberts

*Attorney, Agent, or Firm*—Grace J. Fishel

[57] ABSTRACT

A machine operated implement for cleaning box culverts and other drains and waterways which are generally rectangular in cross section has an elongated body with a plow means at a forward end and a plunger means at a rearward end together with means for wetting dirt in the culvert in advance of said plow means and further means for wetting the dirt in advance of said plunger means.

10 Claims, 6 Drawing Figures

IMPLEMENT FOR CLEANING BOX CULVERTS

This invention relates to a machine operated implement for cleaning box culverts and other drains and waterways which are generally rectangular in cross section.

Box culverts for use under roadways are frequently made out of concrete due to its permanency and structural strength. They are usually cast at the site and are rectangular in cross section. In time, such culverts become filled with slit or clay intermixed with trash, rocks, tree limbs and other debris. Usually culverts are not allowed to become completely plugged before they are cleaned since storm water begins to pond up behind the culvert and this draws attention to the problem. To this day, the dirt in a plugged culvert is usually spaded or scraped loose by hand and then flushed out with water. Any remaining debris is usually left behind particularly if it cannot be easily reached.

In view of the above, there is need for a machine operated implement capable of cleaning box culverts. Therefore, among the several objects of the present invention may be noted the provision of a machine operated implement for cleaning box culverts and other similar drains and waterways. Other objects and features will be in part apparent and in part pointed out.

The invention accordingly comprises the constructions hereinafter described, the scope of the invention being indicated by the subjoined claims. In the accompanying drawings, in which one of various possible embodiments of the invention is illustrated, corresponding reference numerals refer to corresponding parts and in which:

Figure 1:
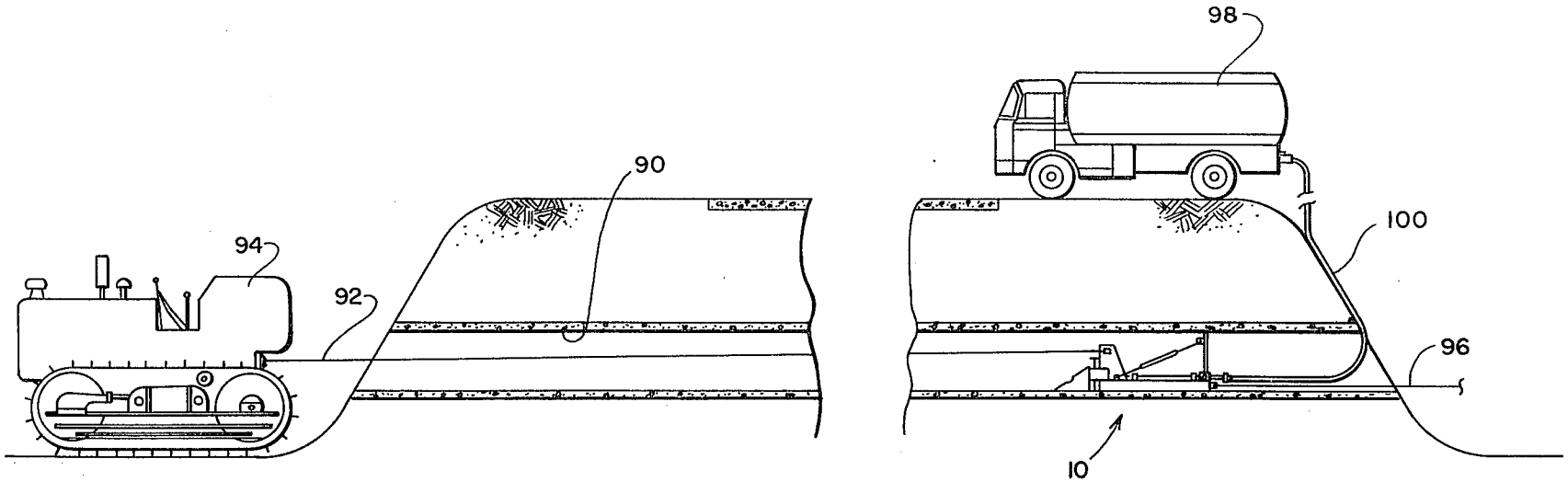
FIG. 1 is a cross-sectional view of a roadway wherein an implement in accordance with the present invention is shown in use.

Referring to the drawings more particularly by reference character, reference numeral 10 refers to an implement in accordance with the present invention. Implement 10 includes a carriage assembly 12 with a plow 14 at its forward end and an adjustable drag plate 16 at its rearward end. Carriage assembly 12 comprises a rectangular frame 18 which is made up of three parallel, symmetrically spaced longer sections of H-beam 20, 22 and 24 butt joined at right angles to two shorter sections of H-beam 26 and 28. A skid 29 is provided on the underside of the frame 18 at each corner.

Figure 2:
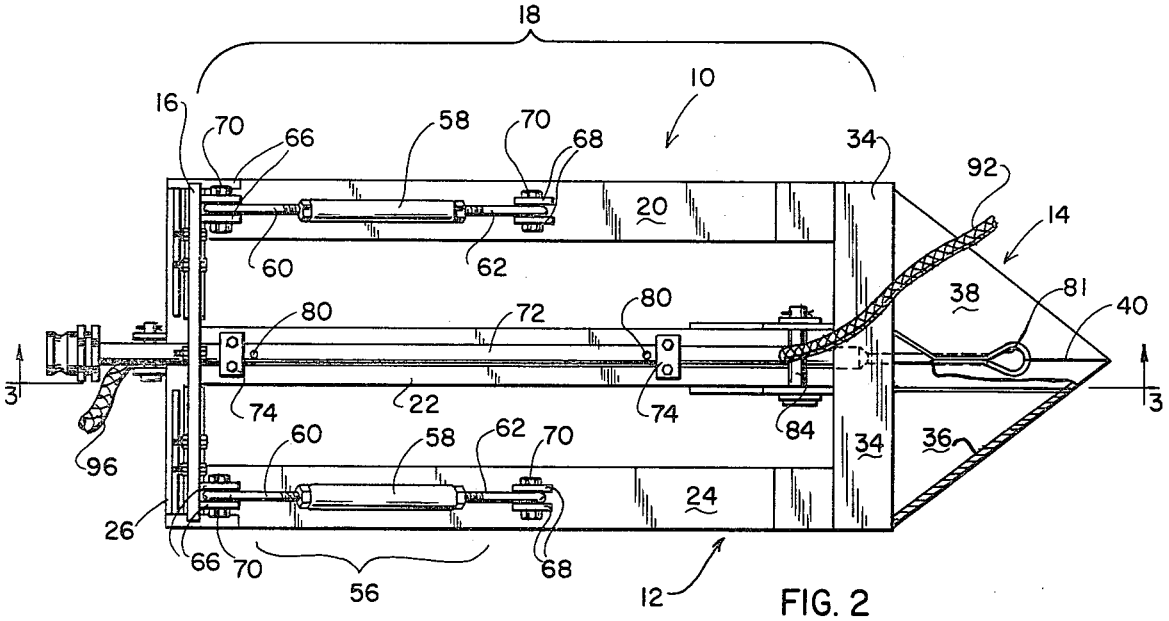
FIG. 2 is a top plan view of said implement having a plow at its forward end and a drag plate at its rearward end.
Figure 4:
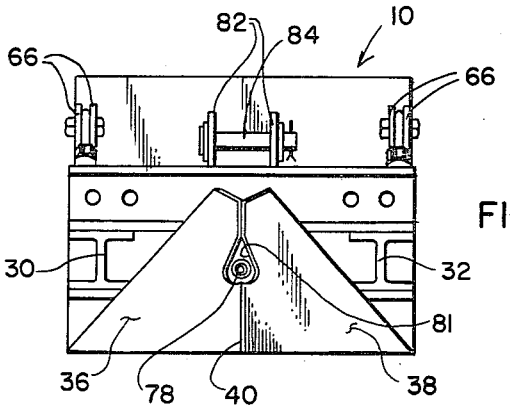
FIG. 4 is a front elevation.
Figure 3:
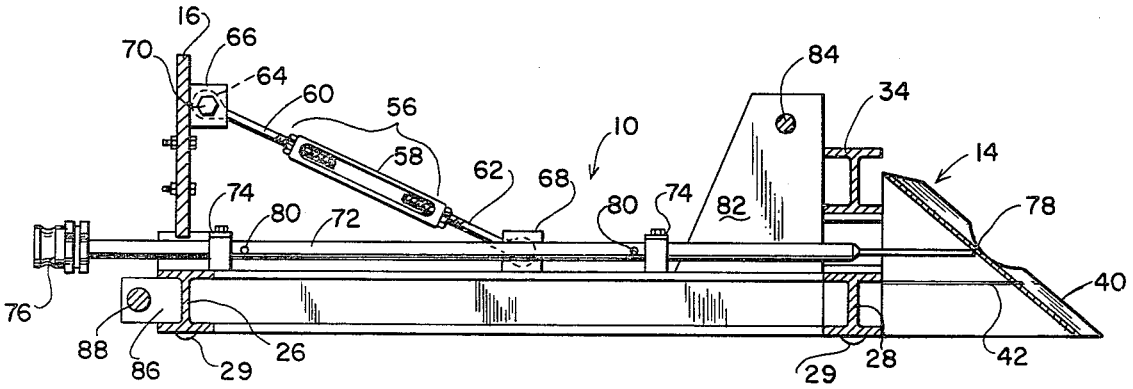
FIG. 3 is a sectional view taken along line 3—3 in FIG. 2.

At its forward end, carriage assembly 12 further includes three additional sections of H-beam 30, 32 and 34 laid in two overlapping layers on frame 12 thus forming a vertical wall at the forward end of said carriage assembly for attachment of plow 14. Sections 30 and 32 are placed on top of sections 20 and 24 as a support for section 34. As best seen in FIGS. 2 and 3, section 34 is the same length as section 28 but is spaced from and in vertical alignment therewith.

Plow 14 is formed from two trapezoidal sections 36 and 38 having shorter and longer nonparallel sides. Each section is joined to carriage assembly 12 along its shorter nonparallel side and to each other along its longer side. Sections 36 and 38 meet in a point 40 and fan outwardly such that the base of the plow is the same width as implement 10 at its lowest point of attachment to carriage assembly 12 and then tapers upwardly so that plow 14 forms a section of a truncated pyramid. A pair of internal triangular braces 42 are attached to the lower side of the upper flange of H-beam 28 and run parallel to the base of the plow substantially midway the height thereof.

Adjustable drag plate 16 includes a rectangular plate 43 mounted on a turn rod 44 attached to one side of said plate adjacent its bottom edge. The ends of turn rod 44 are journaled in a pair of bearing blocks 46 which are attached to the outside edges of sections 20 and 24 adjacent the rear end of frame 18 opposite plow 14. The lower corners of rectangular plate 43 are notched at 48 such that drag plate 16 can be pivoted on turn rod 44 over bearing blocks 46. In order to stop the drag plate in its pivotal movement, bearing blocks 46 are notched at 50. A forward wall 52 of notch 50 stops drag plate 16 substantially vertically while a rearward wall 54 stops it at about 45°.

Drag plate 16 is held at a selected angle by a pair of turnbuckle assemblies 56. Each turnbuckle assembly includes a turnbuckle 58 for screw-threaded engagement with rods 60 and 62, each of which terminates in an eye 64.

The eyed ends of rods 60 are received between a pair of ears 66 attached adjacent opposite side edges of drag plate 16 and a little above center height. A corresponding pair of ears 68 receive the eyed ends of rods 62 and are attached to the outside edges of sections 20 and 24 substantially midway the length thereof. Turnbuckle assemblies 56 are attached at one end to drag plate 16 and at the other to carriage assembly 12 by keyed bolts 70 projecting through ears 66 and 68 and through the eyed ends of rods 60 and 62 positioned respectively therebetween. Within the limits permitted by notches 50, drag plate 16 can be pivoted by simultaneously rotating turnbuckles 58.

A length of pipe 72 is disposed parallel to the longitudinal axis of implement 10 and is attached to the upper flange of H-beam 22 by means of clamps 74. Turn rod 44 is split to allow for passage of pipe 72 at the bottom edge of drag plate 16. Pipe 72 passes between H-beams 30 and 32 and extends well into the interior of plow 14. As shown in the drawings, pipe 72 has a hose coupling 76 at its rear end and a forward directed nozzle 78 at its opposite or front end. Intermediate its ends are a pair of additional nozzles 80 more particularly described hereinafter. Plow 14 includes an aperture 81 in registry with nozzle 78 such that water coming out of said nozzle is sprayed in front of the plow while the nozzle is protected by the plow from damage.

A pair of flanges 82 are attached to frame 19 and to section 34 on the opposite side of the vertical wall formed at the forward end of carriage assembly 12 to which plow 14 is welded. As illustrated, the free ends of flanges 82 are connected by a counter pin 84 having a counter key. Counter pin 84 serves as a forward pull bar for the implement. A pair of smaller flanges 86 are attached to the rear end of carriage assembly 12 preferably on centerline thereof. These flanges are also pinned together with a bolt 88 which serves as a rearward pull bar for dragging the implement out backwards in the event that it becomes stuck in the waterway being cleaned.

The present device is useful in cleaning out box culverts and other similar drains. As shown in FIG. 1, material is cleared by hand from the high end of a culvert 90 and implement 10 put in place on the floor of said culvert with plow 14 pointing towards the opposite end of the culvert.

Box culverts normally installed under roadways are built in a limited number of standard sizes. Because of the way in which the concrete is poured, most irregularities occur in the ceiling. The particular implement 10 brought to the job should be selected so that the width of drag plate 16 is just slightly less than the width of the culvert. This is essential for said drag plate to serve its intended function as a plunging means. It is also preferred that plow 14 have a similar width. If box culvert 90 is not too badly clogged, drag plate 16 should be positioned in elevation by appropriate adjustments of turnbuckles 58 so that it just clears the minimum height of the culvert. If the culvert is more than about 95% clogged, drag plate 16 should be lowered in elevation such that there is a considerable gap between the top of the drag plate and the ceiling of the culvert.

A cable 92 for towing implement 10 is attached to a rod (not shown) and is passed through the top of culvert 90. As aforementioned, culverts are seldom allowed to slit full completely and there is almost always an open space at the top through which the cable can be threaded. One end of cable 92 is then attached to pull bar 84 on implement 10 while the other end is attached to a means for pulling the implement such as a wench or a tractor 94. A second cable 96 is attached to bolt 88 at the rear of implement 10 for dragging the machine out backwards if it becomes lodged in the waterway. A source of water under high pressure like water truck 98 is attached by means of a flexible hose to implement 10 through hose coupling 76.

As implement 10 is towed forward by tractor 94, water is forced out of forward directed nozzle 78 through aperature 81, the said nozzle 78 serving as a first water directing means for spraying water in advance of said plow. The water softens the dirt before it is scraped loose by plow 14. The shape of plow 14 forces the loosed material upward as well as to the sides so that it flows over said plow.

As shown in the drawings, additional nozzles 80 are located along carriage 12 behind the plow and in front of the drag plate. Nozzles 80 provide second water directing means for spraying water behind said plowing means but in advance of the plunging means, which function is provided by the drag plate. It is preferred that these nozzles provide three water jets, one directed upwardly and the other two directed outwardly. As the dirt flows over plow 14, it is further mixed with water and becomes fluidized. This fluid acts as a lubricant on the walls of the culvert 90 and makes implement 10 surprisingly easy to pull.

In those cases where the culvert is badly clogged and implement 10 is used with a gap between the top of drag plate 16 and the ceiling of the culvert, the remaining material can be easily hosed out with flexible hose 100 after it is disconnected from hose coupling 76. Where the implement is used with no gap, substantially no dirt or other debris remains behind.

Figure 5:
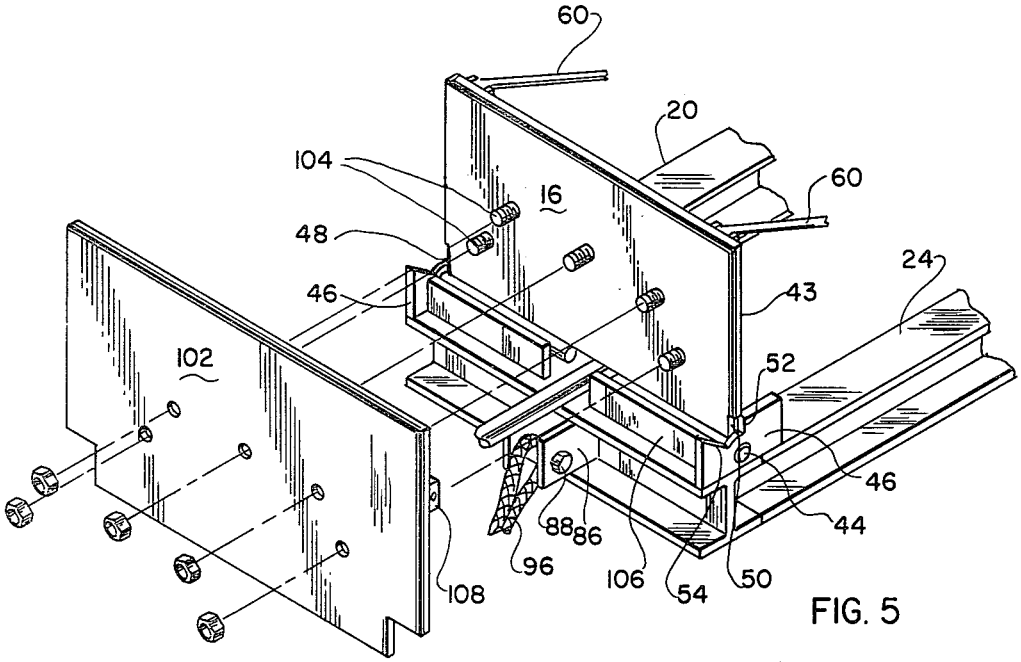
FIG. 5 is an exploded perspective view illustrating attachment of an auxiliary drag plate to the rear of the implement; and, FIG. 6 is a perspective view illustrating attachment of a pair of side guides at the front end thereof.
Figure 6:
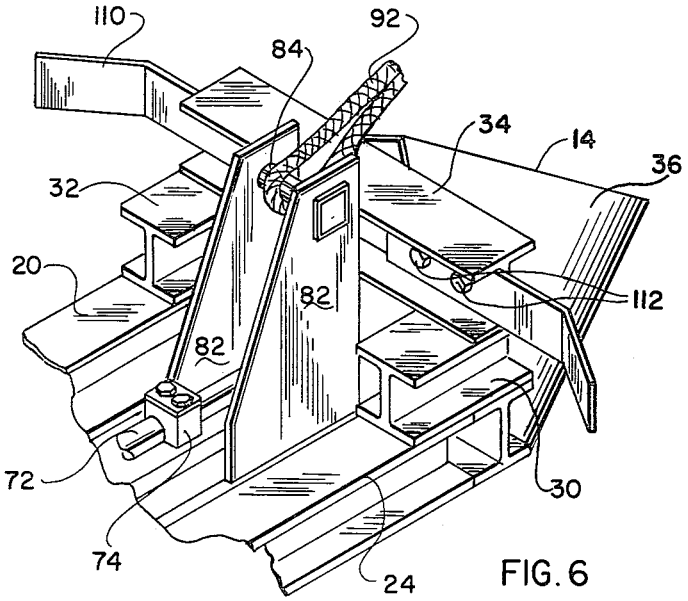

In order to minimize the number of implements necessary to service all of the box culverts normally found under roadways, auxiliary drag plates 102 may be provided as shown in FIG. 5. As illustrated, auxiliary plate 102 is bolted at 104 to drag plate 16. Auxiliary plate 102 is notched at its lower corners such that it can be pivoted on turn rod 44 along with drag plate 16. A back up flange 106 is attached to the upper flange of section 26 just rearward of turn rod 44. As such it reinforces the bottom of drag plate 16 as it is journaled in bearing blocks 46. It also provides an insert flange for receipt of auxiliary plate 102. When plate 102 is considerably larger than drag plate 16, it is preferred that a pair of ears 108 be attached to said auxiliary plate 102 adjacent opposite side edges. In which case, rods 60 are released from ears 66 and attached to ears 108 by means of bolts 70. Turnbuckle assemblies 56 are selected so that the aforementioned attachment can be made.

When implement 10 is used with a large auxiliary drag plate, a pair of lateral side guides 110 may be attached to the forward end of the implement so that the implement tends to stay on centerline as it is dragged through the culvert. As illustrated, guides 110 are attached to the web of section 34 by bolts 112 and are bent at the tips for better resiliency.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. An implement for cleaning box culverts and other drains and waterways having a rectangular cross section, said implement comprising a body with means for plowing at its forward end and plunging means at its rearward end, said means for plowing directing material plowed loose by said plowing means upwardly and backwardly as well as laterally outwardly towards said plunging means, said implement further including a first water directing means for spraying water in advance of said plowing means and a second water directing means for simultaneously spraying water behind said plowing means but in advance of said plunging means, whereby any dirt clogging the culvert or the like is prewetted by said first water directing means before it is plowed loose and is further wetted by said second water directing means before it is swept forward by said plunging means.

2. The implement according to claim 1 wherein the plunging means comprises a gate.

3. The implement according to claim 2 having a second larger gate for attachment to said first gate to provide effective plunging means for larger box culverts or the like.

4. An implement for cleaning box culverts with a rectangular cross section, said implement comprising an elongated body having a plow at its forward end and a drag plate at its rearward end, said plow directing material plowed loose upwardly and backwardly as well as laterally outwardly and backwardly towards said drag plate, said plow and said drag plate being substantially the same width as the culvert being cleaned and said drag plate being substantially the same height as the culvert, said implement further including a first water directing means for spraying water in advance of said plow and a second water directing means for simultaneously spraying water behind said plow but in advance of said drag plate, whereby any dirt clogging the culvert is prewetted by said first water directing means before it is plowed loose and is further wetted by said second water directing means before it is swept forward by said drag plate.

5. The implement according to claim 4 for cleaning box culverts having sidewalls and a ceiling wherein the second water directing means has nozzles for directing water upwardly towards the ceiling as well as laterally towards the sidewalls.

6. The implement according to claim 5 wherein the elongated body comprises a rectangular frame and wherein the drag plate is pivoted at one of its edges to the frame such that if said plate is too high for said culvert it can be effectively reduced in elevation to fit within said culvert.

7. The implement according to claim 6 wherein the drag plate is journaled in bearings selectively restricting the pivotal movement of said plate such that it can be pivoted from vertical in a direction away from the plow to some selected angle.

8. The implement according to claim 7 for use in culverts being wider or higher than the drag plate which further includes an auxiliary drag plate for attachment to said drag plate.

9. The implement according to claim 8 which further includes turnbuckle means attached to the drag plate for holding said drag plate at some angle within which it is otherwise permissibly restricted.

10. The implement according to claim 9 wherein the turnbuckle means are detachably attached to the drag plate and selectively attached to said auxiliary drag plate.

* * * * *

UNITED STATES PATENT AND TRADEMARK OFFICE

CERTIFICATE OF CORRECTION

PATENT NO. :4,216,561

DATED :Aug. 12, 1980

INVENTOR(S) :Jack R. Clifford

It is certified that error appears in the above-identified patent and that said Letters Patent are hereby corrected as shown below:

Column 1, line 12, "slit" should read "silt"; line 57, "joined" should read "jointed"; line 59, "of the frame" should read "of frame". Column 2, line 59, "frame 19" should read "frame 18". Column 3, line 29, "slit" should read "silt". Column 5, line 16, "said plate" should read --said drag plate--.

Signed and Sealed this

*Eleventh* Day of *November 1980*

[SEAL]

*Attest:*

SIDNEY A. DIAMOND

*Attesting Officer*

*Commissioner of Patents and Trademarks*